United States Patent [19]

Brown

[11] Patent Number: 4,489,520

[45] Date of Patent: Dec. 25, 1984

[54] MACHINE TOOL ATTACHMENT

[75] Inventor: Brandt G. Brown, Phoenix, Ariz.

[73] Assignee: Robert R. Griese, Tempe, Ariz.

[21] Appl. No.: 288,657

[22] Filed: Jul. 30, 1981

[51] Int. Cl.[3] ..... B24B 15/00

[52] U.S. Cl. ..... 51/5 D; 51/260; 51/262 T; 125/11 R

[58] Field of Search ..... 51/260, 5 D, 262 T, 51/241 R; 125/11 R

[56] References Cited

U.S. PATENT DOCUMENTS 4,044,506 8/1977 Taketa ..... 51/5 D

FOREIGN PATENT DOCUMENTS 33193 3/1977 Japan ..... 51/260

OTHER PUBLICATIONS

Abrasive Methods Engineering, Farago Received Jun. 1977, pp. 61, 65, 66 & 67.

*Primary Examiner*—Harold D. Whitehead

*Attorney, Agent, or Firm*—Don J. Flickinger

[57] ABSTRACT

A base is securable to the work surface of a machine tool. A centering element, projecting from the base, locates and braces one of a pair of opposed centers in a workpiece while the other center is lapped by a lapping tool carried by the rotatable tool holding means of the machine tool. Also carried by the base is a cutting tool for truing and dressing the lapping tool. The cutting tool is held by a tool holder movable along an axis parallel to the conical surface of the lapping tool.

7 Claims, 5 Drawing Figures

MACHINE TOOL ATTACHMENT

FIELD OF THE INVENTION

This invention relates to machine tools.

In a further aspect, the present invention relates to accessories and attachments for machine tools.

More particularly, the instant invention concerns a center lapping device for use in connection with selected machine tools.

PRIOR ART

In the metal working art, cylindrical shapes are frequently machined between centers. Purportially, a center is drilled into each end of the stock to be machined. The workpiece is then supported between a lathe or other machine tool during machining operations.

The centers are formed into the stock with a rotating, cutting tool known as a combination drill and countersink, sometimes colloquially referred to as a centre drill. Cut by the countersink portion of the tool, the center is a precise 60° conical hole or indentation. Lathe centers are equally accurate. Therefore, the workpiece may be removed and replaced within a single machine tool or moved to another machine tool, also provided with lathe centers, without loss of alignment.

Frequently, a metallic workpiece having been previously machined in a lathe or milling machine, for example, is heat treated during which the workpiece is subjected to elevated temperatures. During initial machining, the workpiece is not brought to finished dimensions, but rather left with additional stock. Heat treating is commonly practiced for the purpose of hardening the workpiece. Subsequently, the additional stock is removed as the workpiece is machined to specified talents, usually by grinding. In addition to hardening, heat treating is employed for other purposes such as drying, annealing, carbonising etc. During the process, phenomena other than the desired result occur. Of immediate importance is the formation of oxidation, scale and other surface deposits. Such deposits destroy the accuracy and precision of the centers. Therefore, it is standard practice to clean and restore the integrity of the center by lapping prior to further machining operations.

The lapping process generally involves stationarily holding the workpiece and urging the center against a rotating conical shaped abrasive wheel. In accordance with a traditional method, the workpiece is manually stabilized on end with the lower center supported upon a conical element held upon the table of a machine tool, such as a drill press. A mounting, grinding wheel, trued and dressed to the specified conical surface and held in the drill chuck, is lowered into the upper center. To insure precision of the centers, the wheel is periodically removed to another machine tool having accurate dressing capabilities.

In an attempt to improve upon traditional methodology, the prior art has provided especially devised machine tools for the purpose. One such device, having a general visual similarity to a conventional drill press, includes a pair of spaced counter-rotating lapping tools. The apparatus further includes a pair of work centering blocks which are adjusted to accommodate workpieces of varying diameter.

The prior art has not, however, provided an entirely satisfactory solution to those having need for such devices. The contrivances are exceedingly complex, having numerous moving components. Lacking are provisions for periodic truing and dressing of the center lapping tool. Further, cost is considered to be excessive for a single purpose, occasionally used, machine tool.

For the foregoing and other reasons, it would be highly advantageous, therefore, to remedy the deficiencies inherent in the prior art.

Accordingly, it is an object of the present invention to provide improvements in devices especially devised for lapping the centers of a workpiece.

Another object of the invention is the provision of an improved attachment for selected machine tools.

And another object of the invention is to provide a device having means for supporting one of a pair of opposed centers formed in a workpiece while the other center is lapped.

Still another object of the invention is the provision of a lapping device which is readily and easily attached to the selected machine tool.

And still another object of the instant invention is to provide a device which will immediately accommodate workpieces of varying diameter.

Yet another object of the invention is the provision of an attachment of sufficiently compact size to be conveniently stowed when not in use.

Yet still another object of the immediate invention is to provide an attachment which is usable with conventional commercially available machine tools without modification thereof.

And a further object of the invention is the provision of a center lapping attachment having integral means for truing and dressing the lapping tool.

Yet a further object of the invention is to provide a center lapping device which is manipulated with conventional skills and tools.

And still a further object of the invention is the provision of a device of the above character which, although durably constructed, is relatively inexpensive to manufacture.

SUMMARY OF THE INVENTION

Briefly, to achieve the desired objects of the instant invention in accordance with a preferred embodiment thereof, first provided is a base securable to the work supporting surface of a machine tool. Center means, carried by the base, engage a center at one end of the workpiece for bracing and locating the workpiece while the other center is restored by lapping means held by the rotatable holding means of the machine tool. Also carried by the base are tool means for dressing and truing the lapping means. The center means and the tool means are alternately alignable with the lapping means.

In accordance with a more specific embodiment of the invention, the center means assumes the form of a conical projection upstanding from the base and matingly engagable with the center formed in either end of the workpiece. The tool means includes a cutting tool for engaging the surface of the lapping means and movable along an axis parallel to the conical surface of the lapping means. More specifically, the tool means includes a movable tool holder carried by a support element upstanding from the base.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DESCRIPTION OF THE PREFERRED EMBODIMENTS

Figure 1:
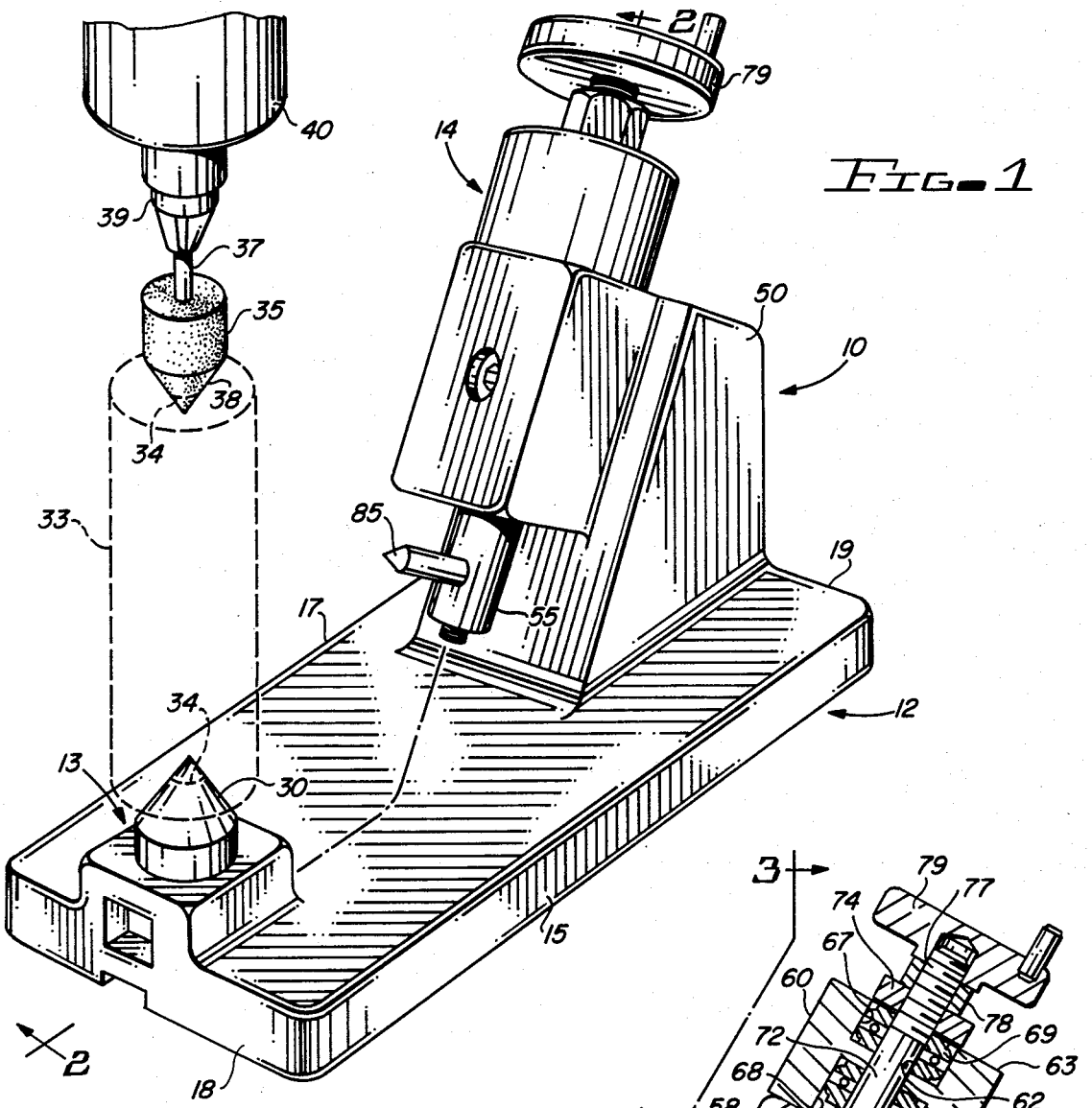
FIG. 1 is a perspective view of a lapping device, constructed in accordance with the teachings of the instant invention, as it would appear when attached to a machine tool and in operation for the purpose of lapping the centers of a workpiece.
Figure 2:
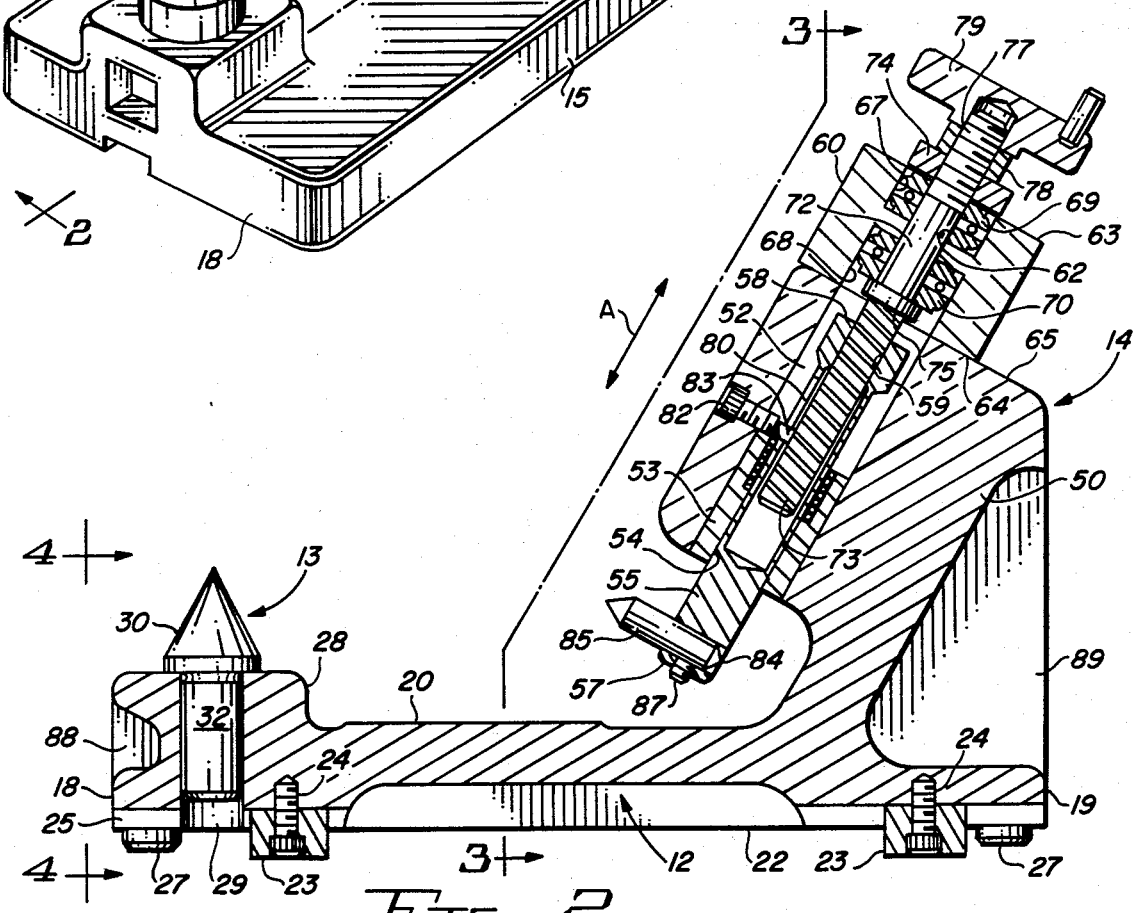
FIG. 2 is a vertical sectional view taken along the line 2—2 of FIG. 1 and further illustrating the operative components thereof.
Figure 3:
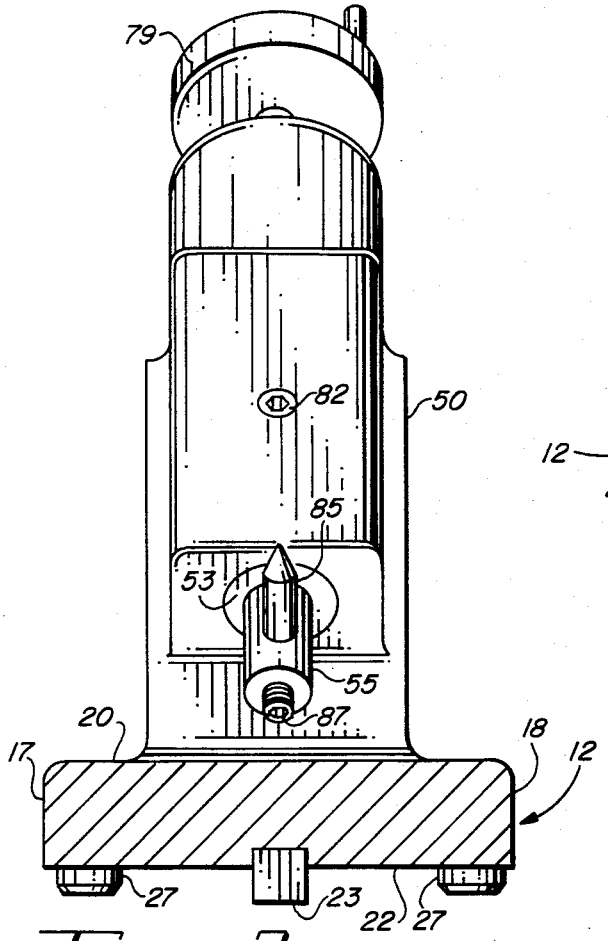
FIG. 3 is a vertical sectional view taken along the line 3—3 of FIG. 2.

Turning now to the drawings in which like reference characters indicate corresponding elements throughout the several views, attention is first directed to FIG. 1 which illustrates machine tool attachment 10 embodying the principles of the instant invention and including a base, center means, and tool means generally designated by the reference characters 12, 13 and 14, respectively. With further reference to FIGS. 2 and 3, it is seen that base 12 is relatively elongate being bounded by longitudinal edges 15 and 17, ends 18 and 19, top surface 20 and bottom surface 22. Center means 13 and tool means 14 project upwardly from top surface 20. Bottom surface 22 is adapted to bear against the normal work supporting surface of a conventional machine tool.

Many machine tools, such as milling machines for example, include a movable table having a plurality of parallel alignment slots formed into the working surface. For purposes of alignment upon the table, attachment 10 is provided with a pair of spaced alignment elements 23 depending from bottom surface 22 of base 12. The alignment elements 23, which are secured to base 12, in accordance with conventional means by screws 24, are sized to be locationally received within the alignment slots 25. In order that the alignment elements 23 may be removed and replaced without loss of alignment relative attachment device 10, the elements 23 reside within slot 25. Elements 23 are locationally received within slot 25 which extends along an axis aligned with the axis of cutting means 13 and tool means 14. The device may also be provided with a set of button feet 27, the use and reasons for which will be apparent to those skilled in the machine art.

Boss 28 rises from top surface 20 of base 12 proximate end 18. Bore 29, having an axis perpendicular to bottom surface 22 and intersecting the axis of slot 25, extends through base 12 at boss 28. Center means 13 includes upwardly convergent conical element 30 and shank 32, the latter residing within bore 29. In accordance with conventional practice, shank 32 may be press-fitted into bore 29.

As seen in FIG. 1, conical element 30 braces and locates cylindrical workpiece 33, shown in broken outline, during the lapping operation. Workpiece 33 is provided with a center 34 at either end thereof. The lower center 34 is engaged with conical element 30 when workpiece 33 is manually stabilized in the vertical position by the workman. Lapping means 35 is herein specifically illustrated as a mounted grinding wheel having shank 37 and conical surface 38. Shank 37 is held and rotatably driven by the normal work holding means 39 associated with spindle 40 of a conventional machine tool, such as a milling machine. While workpiece 33 is held and stabilized as described, spindle 40 is lowered engaging conical surface 38 within center 34 for the purpose of restoring integrity to center 34. As will be appreciated by those skilled in the art, machine tool attachment 10 may be secured to the normal work supporting surface of the machine tool by any conventional means, such as various hold-downs and clamps commonly available in metal working facilities.

During the lapping operation, particles of scale from the heat treating process and bits of metal become embedded in surface 38, the lapping surface of lapping means 35. The surface also becomes dull and deformed thereby losing the capability of accurately lapping, or machining, center 34. Accordingly, periodic truing and dressing of surface 38 is mandatory. The truing and dressing operation is accomplished by tool means 14.

As specifically seen in FIG. 2, tool means 14 includes support structure 50 projecting upwardly from base 12 proximate end 19 as specifically view in FIGS. 1, 2 and 3. Bore 52 extends through support structure 50 along an axis displaced from the vertical to agree with the desired slope of conical surface 38. Usually, center 34 and surface 38 are sixty degree included cones. Correspondingly, the axis of bore 52 is displaced thirty degrees from vertical as seen in FIG. 2. When viewed in the direction of FIG. 3, the axis of bore 52 is vertical to surface 22 and passes through the axis of slot 25. Residing within bore 52 is bushing 53 having in turn bore 54. Tool holder 55, having lower end 57 and upper end 58, is slidably disposed within bore 54. Extending inwardly from end 58 is threaded bore 59.

Bearing block 60, having bore 62, upper end 63 and lower end 64, is secured to the upper surface 65 of support structure 50 in accordance with conventional means. Bearing block 60 is considered to be a portion of support structure and may be integral therewith. However, for purposes of ease of assembly during fabrication, it is generally desired that bearing block 60 be separable from support structure 50. Counterbores 67 and 68 project inwardly from ends 63 and 64, respectively. Thrust bearings 69 and 70 reside within counterbores 67 and 68, respectively. Lead screw 72, having lower threaded portion 73 engaged within threaded bore 59 of tool holder 55, is rotatably journaled within bore 62 and thrust bearing 69 and 70. Thrust collars 74 and 75 reside outboard of thrust bearing 69 and 70, respectively. Lead screw 72 further includes a threaded upper end portion 77 upon which is engaged nut 78. Nut 78 is used to adjust the tension of collars 74 and 75 over thrust bearings 69 and 70. Nut 78 also functions as a jam nut for retention of hand wheel 79 which is also threadedly engaged upon threaded portion 77.

In accordance with the foregoing description, it will be appreciated that tool holder 55 is movable in the directions indicated by the double arrowed line A in response to rotation and counter-rotation of hand wheel 79.

Formed in tool holder 55 is longitudinal groove 80. Set screw 82 is threadedly engaged within support structure 50. Projection 83, extending from set screw 82, is closely, slidably received within groove 80. Accordingly, tool holder 55 is stabilized against rotation.

Transverse bore 84, having an axis substantially lying in the previously described plane, extends transversely through tool holder 55 near end 57. Truing and dressing tool 85 is held in bore 84 by set screw 87. Dressing tool 85 is selected from among various commercially available dressing tools compatible with the selected lapping means 35. In accordance with the immediately described embodiment of the invention, truing and dressing tool 85 may be a diamond-tipped dressing tool especially adapted for truing and dressing grinding wheels.

Figure 4:
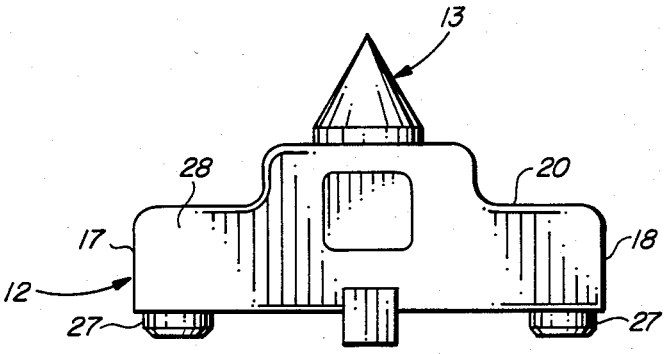
FIG. 4 is an elevation view of the left end of the device with reference to FIG. 2.

With reference to FIGS. 2 and 4, it is seen that a pair of opposed recesses 88 and 89 are formed into base 12 from ends 18 and 19, respectively. The recesses 88 and 89 receive the operator's fingers and provide convenient means for lifting the apparatus.

The use of attachment 10 for the purpose of truing and dressing lapping means 35 will now be described with reference to FIG. 5. Beginning from the lapping position, as illustrated in FIG. 1, relevant movement in the directions indicated by arrowed lines B and C, is imparted between lapping means 35 and attachment 10. The movement is readily accomplished by various methods in accordance with the specifically chosen machine tool. In a conventional vertical milling machine, movement in the direction of arrowed line B is a result of horizontal movement of the work supporting table. Lowering the spindle provides movement in the direction of arrowed line C. In other machines, having fixed spindles, movement in both directions is accomplished by the work support table. When used with machines having a fixed table, such as radial drill press, the movement is accomplished entirely by the spindle. The foregoing references refer to machines having spindles rotatable about a generally vertical axis which is perpendicular to the work support surface of the machine tool. Mounting base 12, upon a conventional angle plate, extends the utility of the apparatus to other machines, such as lathes and vertical milling machines, in which the spindle rotates about a generally horizontal axis lying in a plane parallel to the work supporting surface. It is noted herein that it is conventional practice to mount a rotatable cutting tool in the spindle of a lathe and clamp a work supporting element to the carriage. The device is further usable in connection with certain tools, such as drill presses having either flat or slotted tables, in which movement in the direction of arrowed line B is accomplished by moving apparatus 10 relative the work supporting surface.

Figure 5:
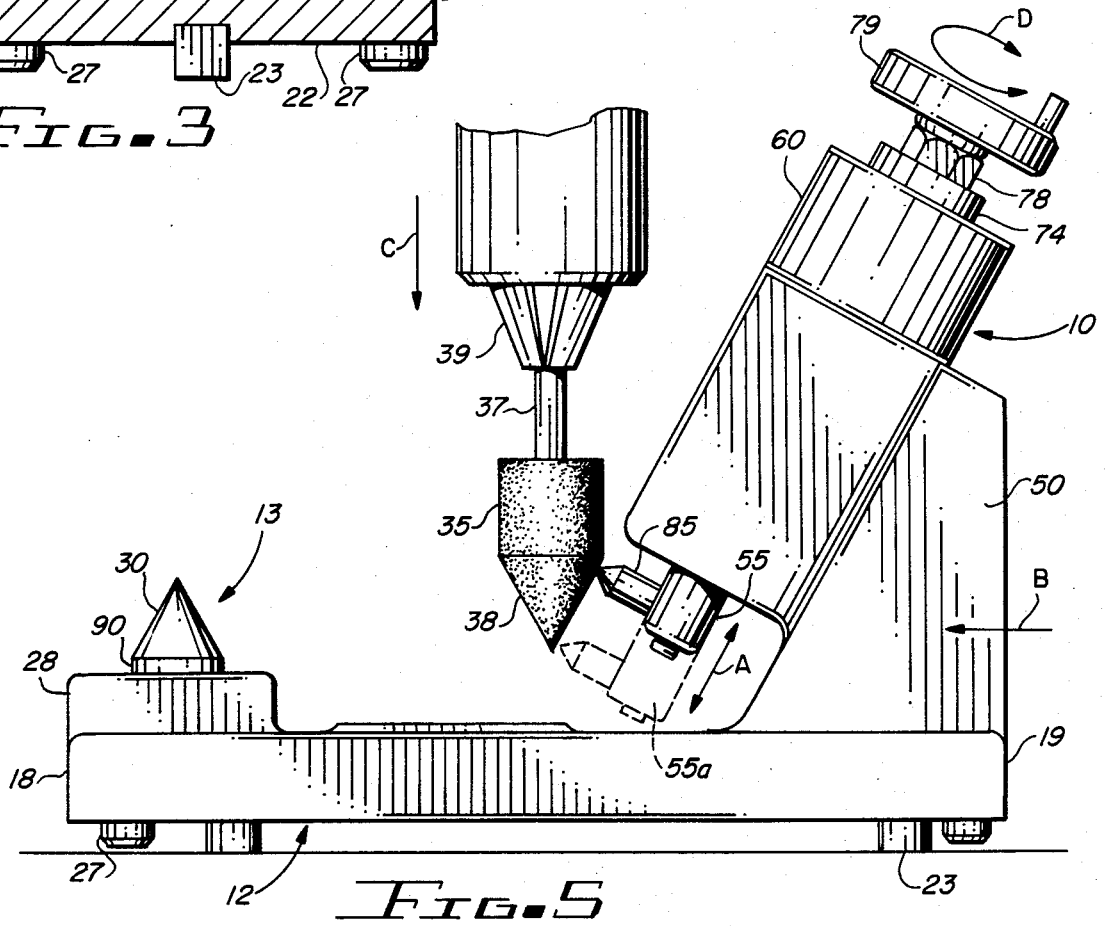
FIG. 5 is a front elevation view of the apparatus of the instant invention in the general environmental setting of FIG. 1 as it would appear during an alternate operational mode while truing and dressing the lapping means held by the machine tool.

After the position as illustrated in FIG. 5 has been assumed, with the cutting tip of tool 85 touching surface 38, hand wheel 79 is rotated in the directions as indicated by the arrowed line D. Resultingly, tool holder 55 moves in the directions indicated by the double arrowed line A and further shown by the solid outline 55 and the broken outline 55*a*. Accordingly, surface 38 is trued and dressed in accordance with conventional procedure. After restoration of integrity to surface 38, movement is imparted in directions counter to the directions indicated by arrowed lines B and C to assume the lapping position illustrated in FIG. 1. As will be readily apparent to those skilled in the art, accurate alignment between the conical surface 38 and conical element 30 may be readily accomplished with a dial indicator held in chuck 39 and rating upon cylindrical surface 90 of conical element 30. After noting the point of alignment, such as on the dial wheel associated with most machine tools, the apparatus may be moved to the lapping position after truing and dressing the lapping means without subsequent alignment procedures.

Various changes and modifications to the embodiment herein chosen for purposes of illustration will readily occur to those skilled in the art. To the extent that such modifications and various do not depart from the spirit of the invention, they are intended to be included within the scope thereo which is assessed only by a fair interpretation of the following claims.

Having fully described and disclosed the present invention in such clear and concise terms as to enable those skilled in the art to understand and practice the same, the invention claimed is:

1. In a machine tool including,
a work supporting surface,
rotatable tool holding means, and
lapping means carried by said tool holding means and having a conical surface,
an attachment for said machine tool for supporting a workpiece, said workpiece having a pair of opposed centers, while said lapping means is operated upon one of said centers and for alternately dressing and truing said lapping means, said attachment comprising:
a. a base securable to the work supporting surface of said machine tool;
b. center means carried by said base for holding and bracing said workpiece; and
c. tool means carried by said base for dressing and truing said lapping means, said center means and said tool means being alternately and selectively alignable with said lapping means.

2. The attachment of claim 1, wherein said tool means includes:
a. a cutting tool for engaging the surface of said lapping means; and
b. means for moving said cutting tool along an axis parallel to the conical surface of said lapping means.

3. The attachment of claim 2, wherein said means for moving said cutting tool includes:
a. a support structure upstanding from said base;
b. a tool holder carried by said support structure for holding said cutting tool; and
c. means for moving said tool holder along said axis.

4. The attachment of claim 3, further including:
a. bore in said support structure for slidably receiving said tool holder; and
b. means for preventing rotation of said tool holder within said bore.

5. The attachment of claim 3, wherein said means for moving said tool holder includes:
a. a threaded bore extending within said tool holder along said axis;
b. a lead screw threadedly engaged within said bore;
c. means for preventing said lead screw from moving along said axis; and
d. means for rotating said lead screw.

6. The attachment of claim 1, wherein said center means includes a conical center upstanding from said base.

7. The attachment of claim 1, further including a pair of opposed recesses formed in said base.

* * * * *